United States Patent [19]

Takeo et al.

[11] 3,984,339

[45] Oct. 5, 1976

[54] HYDRAULIC OIL COMPOSITION

[75] Inventors: Kimihiko Takeo; Yukikazu Omura, both of Nobeoka, Japan

[73] Assignee: FMC Corporation, Philadelphia, Pa.

[22] Filed: Oct. 5, 1973

[21] Appl. No.: 403,917

[52] U.S. Cl. ..... 252/74; 260/212; 252/72; 536/56

[51] Int. Cl.[2] ..... C09K 50/00

[58] Field of Search ..... 252/74, 72; 260/212

[56] References Cited

UNITED STATES PATENTS

| | | | |
|---|---|---|---|
| 2,978,446 | 4/1961 | Battista et al. | 260/212 |
| 3,047,507 | 7/1962 | Winslow | 252/74 X |
| 3,373,107 | 3/1968 | Rice et al. | 260/583 R |
| 3,763,046 | 10/1973 | Beazley et al. | 252/74 X |

*Primary Examiner*—Harold Ansher
*Assistant Examiner*—Patricia C. Ives

[57] ABSTRACT

A hydraulic oil composition having a large Winslow effect containing an electrical insulating oil, a water-soluble electrolyte, a liquid having a high dielectric constant, and microcrystalline cellulose particles.

10 Claims, No Drawings

HYDRAULIC OIL COMPOSITION

The present invention relates to a hydraulic oil composition having a large Winslow effect which is adapted for use, for example, in known hydraulic control systems.

As employed herein, the terminology "Winslow effect" is that phenomenon which is produced by subjecting a suspension (electroviscous fluid), composed essentially of (1) oil, (2) hydroscopic particles and (3) water or other liquids having a high dielectric constant, to an external electric field whereby the viscocity of the suspension increases approximately in proportion to the square of the strength of the electric field. A "Winslow valve", which may function, for example, as an oil pressure valve in a hydraulic control system, is one formed of a pair of coaxial, telescoped, spaced cylinders between which flows the above-described suspension, and in which the fluidity of the suspension is controlled by using the telescoped cylinders as electrodes and varying a voltage which is impressed across the same.

Known in the art are suspension or hydraulic oil compositions containing micropowdered silicates. In a hydraulic control system such compositions exhibit the Winslow effect, but the hard-surface silicate grains rapidly abrade internal surfaces of such system. This abrasion is particularly apparent along the systems' pump walls and the cylinder walls of thw Winslow valve which results in reduced pump efficiency and a sacrifice in the intensity of the electric field across the valve cylinder electrodes.

Micropowdered silicates, as well as other inorganic particles, such as aluminum powders, and organic materials, as for example, starch, are also unsatisfactory for use in hydraulic oil compositions in view of their chemical instability and the impurities which they may contain. In time, either or both of these factors will cause deterioration of the composition and the Winslow effect which may originally have been present.

Of further significance is that the Winslow effect exhibited by known hydraulic suspensions or compositions is comparatively small, making it difficult to control the fluidity of the composition along flow areas which are of greatest width or depth, and permitting variation in the characteristics of a Winslow valve within a range (as defined by the ratio between the controllable maximum and minimum flow) which is very narrow.

Also known in the art are hydraulic oil compositions containing a dispersion of microcrystalline cellulose particles or granules which, in a hydraulic control system having a Winslow valve, provides a Winslow effect. The present invention is predicated upon the discovery that the addition of a small amount of an aqueous-soluble electrolyte to such known hydraulic suspension or composition provides for marked increase in the Winslow effect which is exhibited by the composition.

Microcrystalline cellulose, as used herein, is the insoluble residue obtained from the chemical decomposition of natural or regenerated cellulose, and it is characterized by having a level-off degree of polymerization determined by the method stated in "Industrial and Engineering Chemistry", Volume 42, pages 502–7 (1950). The preferred method of forming this microcrystalline cellulose and the details of its characteristics are disclosed, for example, in U.S. Pat. No. 2,978,446, French Pat. No. 1,194,486 and others.

In the hydrolysis of cellulose, the amorphous portions of the original cellulose chains are dissolved, the undissolved protions being in a particulate, non-fibrous or crystalline form as a result of the disruption of the continuity of the fine structures between crystalline and amorphous regions of the original cellulose. Although hydrolysis may be effected by various specific methods, including the use of various acids, bases and enzymes, a direct method which is free of secondary reactions comprises the treatment of the original cellulosic material with 2.5 normal hydrochloric acid solution for 15 minutes at boiling temperature. Another suitable method comprises treating the cellulosic material with 0.5% hydrochloric acid solution (0.14 normal) at 250°F. for 1 hour. The microcrystalline cellulose or cellulose crystallite aggregates resulting from hydrolysis and washing steps are further characterized by having a particle size in the range of 1 or 2 to 250 to 300 microns, as determined visibly by microscopic examination. By subjecting the foregoing product to a mechanical disintegration, there is produced a material having a size in the range of less than 1 to about 250 or 300 microns. Within this range, the particle size and size distribution are variable, it being understood that the size and size distribution can be selected to suit a particular end use. In general, mechanically disintegrated particles are preferred.

On drying the attrited hydrolysis products, for example, by freeze drying, spray drying, drum drying, solvent displacement and the like, some coalescence will occur to reform larger particles of microcrystalline cellulose but these are well below a particle size of 300 microns, preferably averaging between about 20 and 100 microns in their largest dimension. In short, this material contains substantially no amorphous area of cellulose, and has a particle size less than about 300 microns (Stokes diameter).

This microcrystalline cellulose is characterized by its extremely low content of ash, which is attributed to the fact that microcrystalline cellulose has almost no amorphous region, and, accordingly, inorganic ash contained chiefly in amorphous regions has been dissolved and removed.

To illustrate the merits of the present invention a mixture, containing 85 parts of liquid paraffin and 15 parts of microcrystalline cellulose particles or aggregates which had been adjusted to a 9 weight percent moisture content, was divided into five samples, afterwhich four of such samples were modified by the addition of 0.015 part; 0.075 part; 0.15 part; and 0.75 part, respectively, of a water-soluble electrolyte and specifically ammonium chloride. Upon separately mixing and attriting the samples in a ball mill for 24 hours, the microcrystalline cellulose dispersoid particles became oval in shape, having a major axis of from 5 to 10 microns.

Employing a modified coaxial, double cylinder type rotating viscometer, in which the inner and outer cylinder served as electrodes, the viscosity of each sample was determined using an electric field having an intensity of 3.0 kv/mm and a shear gradient of 161 sec. $^{-1}$. The viscosity of the respective samples, in the order of increasing amounts of ammonium chloride present, were as follows: 4100 dyne/cm$^2$ (having no ammonium chloride); 5600 dyne/cm$^2$; 4200 dyne/cm$^2$; 2200 dyne/cm$^2$ and 900 dyne/cm$^2$.

The Winslow effect (the maximum shearing stress) is most apparent when employing from 0.05 to 0.5 weight percent of water-soluble electrolyte, based upon the weight of the microcrystalline cellulose which is employed in the composition. Similar results to those expressed above has been achieved using other water-soluble electrolytes, such as sodium chloride, lithium chloride, magnesium chloride, aluminum sulfate, and the like.

The reason for the increase in the Winslow effect exhibited by the hydraulic oil composition by the presence of a comparatively small amount of a water-soluble electrolyte is not understood since the mechanism which gives rise to the Winslow effect itself has not yet been determined.

As to Winslow effect, it is believed that the moisture absorbed by the dispersion particle forms a second interfacial electric layer with the oil phase interface and, in the absence of an electric field, this second interfacial layer is spread evenly over the particle surfaces. When exposed to an external electric field, this second interfacial electric layer is distorted into an oval shape, expanding in the direction of the electrode having a charge opposite to that of the free ion composing such second layer.

The dispersion particles, having an electric charge opposite to that of its free ion composing the second interfacial layer, tend to move toward an electrode in a direction opposite to that of the second interfacial electric layer. As a result, it appears that this second interfacial electric layer is polarized in the direction of an electrode, with positive and negative charges being beside the center as compared with the ion atmosphere.

As a result of this polarization, electric charges on the surfaces of adjacent dispersion particles which have been electrically strained, create a static state, mutually repelling or attracting each other, which give the dispersion the appearance of having increased viscosity.

The external electric field may be either DC or AC, with the only difference being that, with the latter, the direction of movement of the ion atmosphere and the particle will change in correspondence with the reversal in the direction of the electric field.

As to the influence of the ammonium chloride, or other water-soluble electrolytes employed in the composition of the present invention, on the Winslow effect, it is believed that the free ions which are present upon the dissociation of the electrolyte, adhere to the dispersion particles, increasing the intensity of the charge of the electrically strained second interfacial layer and causing a more pronounced distortion or expansion of the same. When excessive water-soluble electrolyte is used, it is assumed that the increase in the intensity of the charge of the electrically strained second interfacial layer is such as to raise the dielectric constant and permit a weak current to flow between the electrodes. The mutual repulsion or attraction of adjacent dispersion particles, as described above, is therefore weakened and the Winslow effect is reduced.

It has been established that in a hydraulic oil composition having optimum characteristics, that effect produced by the addition of the water-soluble electrolyte varies with the amount of water absorbed by the dispersion particles and the concentration of such dispersion particles. Thus in a hydraulic oil composition of the present invention having a high Winslow effect and consisting of an oil (A) having high electrical insulating properties, which serves as a dispersion medium, a water-soluble electrolyte (B), water or other lliquid (C) having a high dielectric constant and microcrystalline cellulose particles (D), the relative proportions of the composition constituents are determined by the following formulas in which the constituents are A, B, C and D in parts by weight.

(a) $\frac{B}{D} = 0.0001$ to 0.02 (preferably from 0.0005 to 0.005)

(b) $\frac{D}{A+D} = 0.03$ to 0.25

(c) $\frac{C}{C+D} = 0.03$ to 0.15

The microcrystalline cellulose particles or aggregates employed as dispersion particles in the hydraulic oil composition of the present invention have a moderate hardness and product no abrasive effects on the inside surfaces of hydraulic control devices with which such composition is used and, due to their chemical stability and purity, cause no deterioration in the composition, even after long usage. Such particles have great water absorbency and can readily assume from 3 to 15% of water as is essential for use in the composition of the present invention. The absorption of water by such particles can be controlled to a desired optimum amount for example, by mixing and agitating the particles with the oil dispersion medium into which water has been added whereby the water is assumed by the particles. While water is preferred, other liquids having a high dielectric constant may be used in the composition of the present invention, as for example, formamide, methyl alcohol, ethyl alcohol, etc.

The size of the microcrystalline cellulose particles employed may be varied, with particles of from 0.2 to 50 microns and, more preferably from 0.5 to 10 microns, being satisfactory. Particles larger than 50 microns have a detrimental affect upon the fluidity and the electrical insulating properties of the oil dispersion medium.

The dispersion medium referred to herein is an electric insulating oil or an oil mixture having a chemically stable viscosity of 2 to 300 centi-poise (25°C) to which a small amount of other kind of oil, having an adequate viscosity in poise, may be added to improve the temperature characteristics of viscosity. These insulating oils include oleic acid, linoleic acid, silicone oil, JIS transformer oil, aromatic oil, paraffin naphtene, and mixtures of the last two mentioned kinds.

Suitable water-soluble electrolytes include all salts which ae dissociable into cations and anions, as for example, sodium chloride, ammonium chloride, ammonium sulfate, magnesium chloride, sodium acetate, potassium tartrate, sodium oleic acid, potassium oleic acid. Other water-soluble electrolytes include the bases, such as sodium hydroxide, lithium hydroxide, potassium hydroxide, as well as acids, for example hydrochloric and sulfuric acids, although the use of such acids is not desirable since they have a detrimental affect upon the dispersion medium and particles and the internal surfaces of hydraulic pressure control systems.

The aforementioned water-soluble electrolytes may be added to a mixture, consisting of (1) an oil dispersion medium, (2) microcrystalline cellulose particles; and (3) water or other high dielectric constant liquid, in a solid form and be dispersed by mixing, or may be dissolved in water or other high dielectric constant liquid which is an essential component of the composition.

Aside from the oil dispersion medium, microcrystal cellulose particles, water-soluble electrolyte, and water or other liquid having a high dielectric constant, the composition of the present invention may include anti-rust and anti-foaming agents, if necessary or desired.

To further illustrate the merits of the present invention, reference is made to the following Examples, in which all amounts are in parts by weight unless otherwise indicated.

EXAMPLE I

A mixture of 85 parts of liquid paraffin, 15 parts of microcrystalline cellulose aggregates, having 9 weight percent of absorbed water, and 0.015 part of ammonium chloride in a solid form was treated in a ball mill for 24 hours, afterwhich its viscosity was determined in the presence of an electric field using a rotating viscometer of the modified coaxial double cylinder type. With an electric field of 3.0 kv/mm and a shearing speed of 344 sec. $^{-1}$, the mixture had a viscosity of 5400 dyne/cm$^2$.

EXAMPLE 2

A mixture as described in EXAMPLE 1, except having no water-soluble electrolyte, was subjected to the conditions as described in EXAMPLE 1, and had a viscosity of 4300 dyne/cm$^2$.

EXAMPLE 3

A mixture of 90 parts of silicone oil having a viscosity of 20 CPS (25°C), 10 parts of microcellulose crystalline aggregates, having 5.6 weight percent of absorbed water, and 0.05 part of sodium chloride was treated in a ball mill for 24 hours. The viscosity of this mixture, determined under the conditions described in EXAMPLE 1, was 3900 dyne/cm$^2$.

EXAMPLE 4

A mixture as described in EXAMPLE 3, except having no water-soluble electrolyte, was subjected to the conditions as described in EXAMPLE 1 and had a viscosity of 1500 dyne/cm$^2$.

EXAMPLE 5

This experiment was performed to establish the limitations as defined by the formulas heretofore described; namely (a) $\frac{B}{D}$ = 0.0001 to 0.02 (preferably from 0.0005 to 0.005)

(b) $\frac{D}{A+D}$ = 0.03 to 0.25

(c) $\frac{C}{C+D}$ = 0.03 to 0.15

Various mixtures were prepared and the viscosities thereof were determined under the conditions described in EXAMPLE 1. The mixtures employed and their viscosities are set forth in TABLE 1.

TABLE 1

| No. | Oil dispersion medium (liquid paraffin) (weight part) | Crystalline cellulose (dispersion) Weight added (part) | Crystalline cellulose (dispersion) Water Content (%) | Weight of ammonium chloride added (part) | Shearing stress (dyne/cm$^2$) (note-1) |
|---|---|---|---|---|---|
| 1 | 85 | 15 | 9 | 0.0 | 4300 |
| 2 | 85 | 15 | 9 | 0.0075 | 3900 |
| 3 | 85 | 15 | 9 | 0.015 | 5400 |
| 4 | 85 | 15 | 15 | 0.0 | 3200 |
| 5 | 85 | 15 | 15 | 0.015 | 4200 |
| 6 | 75 | 25 | 5.4 | 0.00 | 3200 |
| 7 | 75 | 25 | 5.4 | 0.015 | 4300 |
| 8 | 85 | 15 | 20 | 0.0 | 1200 |
| 9 | 85 | 15 | 20 | 0.015 | 1200 |

(Note-1) Field strength 3.0 kv/mm
Shearing strength 344 sec. $^{-1}$

EXAMPLE 6

In this experiment, the amounts of the components of the present invention, and in some instances the components themselves, were varied. The mixtures employed and their viscosities are set forth in Table 2.

Table 2

| No. | Oil dispersion medium nomenclature | Oil dispersion medium added vol. | Crystalline cellulose aggregates added vol. (weight) | Crystalline cellulose aggregates water content (%) | Water-soluble electrolyte nomenclature | Water-soluble electrolyte added vol. (weight part) | Shearing stress (dyne/cm$^2$) (note-2) |
|---|---|---|---|---|---|---|---|
| 1 | dibutyl sebacate | 85 | 15 | 5.4 | lithium chloride | 0.075 | 1300 |
| 2 | dibutyl sebacate | 85 | 15 | 5.4 | magnesium chloride | 0.075 | 1100 |
| 3 | dibutyl sebacate | 90 | 10 | 5.4 | sodium acetate | 0.050 | 1000 |
| 4 | liquid paraffin | 90 | 10 | 5.4 | magnesium chloride | 0.040 | 1050 |
| 5 | liquid paraffin | 90 | 10 | 5.4 | potassium chloride | 0.010 | 1200 |
| 6 | liquid paraffin | 90 | 10 | 5.4 | lithium chloride | 0.010 | 1200 |
| 7 | oleic acid | 85 | 15 | 5.7 | sodium acetate | 0.060 | 1000 |
| 8 | oleic acid | 90 | 10 | 5.7 | potassium tartrate | 0.080 | 1000 |
| 9 | ortho-chlor-toluene | 90 | 10 | 5.7 | aluminum sulfate | 0.040 | 900 |
| 10 | ortho-chlor-toluene | 90 | 10 | 5.7 | potassium chloride | 0.020 | 1200 |

(note-2) Shearing velocity: 518 (sec. $^{-1}$)
Field strength 3.0 (kv/mm)

It is to be understood that changes and variations may be made without departing from the spirit and scope of the invention as defined in the appended claims.

We claim:

1. A hydraulic oil composition having a large Winslow effect comprised of an electrical insulating oil (A), a water-soluble electrolyte (B), a liquid (C) selected from the group consisting of water, formamide, methyl alcohol and ethyl alcohol, and microcrystalline cellulose particles (D), said constituents A, B, C and D being present, in parts by weight, in accordance with formulas, as follows:

(a) $\frac{B}{}$ = 0.0001 – 0.02

$_D$ -continued (b) $\frac{D}{A+D} = 0.03 - 0.25$ (c) $\frac{C}{C+D} = 0.03 - 0.15$

2. A hydraulic oil composition as defined in claim 1 wherein the formula (a) of $B/D = 0.0005 - 0.005$.

3. A hydraulic oil composition as defined in claim 1 wherein the microcrystalline cellulose particles (D) have dimensions of from 0.2 to 50 microns.

4. A hydraulic oil composition as defined in claim 3 wherein the microcrystalline cellulose particles have dimensions ranging from 0.5 to 10 microns.

5. A hydraulic oil composition as defined in claim 1 wherein the electrical insulating oil (A) is one having a chemically stable viscosity of 2–300 centipoise at 25°C.

6. A hydraulic oil composition as defined in claim 1 wherein the liquid (C) having a high dielectric constant is water.

7. A hydraulic oil composition as defined in claim 2 wherein the microcrystalline cellulose particles (D) have dimensions ranging from 0.5 to 10 microns.

8. A hydraulic oil composition as defined in claim 7 wherein the electrical insulating oil (A) is one having a chemically stable viscosity of 2–300 centipoise at 25°C.

9. A hydraulic oil composition as defined in claim 7 wherein the liquid (C) having a high dielectric constant is water.

10. A hydraulic oil composition defined in claim 8 wherein the liquid (C) having a high dielectric constant is water.

* * * * *

UNITED STATES PATENT OFFICE

CERTIFICATE OF CORRECTION

Patent No. 3,984,339 Dated October 5, 1976

Inventor(s) Kimihiko Takeo and Yukikazu Omura

It is certified that error appears in the above-identified patent and that said Letters Patent are hereby corrected as shown below:

Col. 2, line 32, change "are well below" to read --are all well below--.
Col. 3, line 4, change "has" to read --have--;
line 41, change "particle" to read --particles--.
Col. 4, line 18, change "product" to read --produce--
line 51, change "ae" to read --are--.
Col. 6, claim 1, formula (a) should read --$\frac{B}{D} = 0.0001 - 0.02$--.

Signed and Sealed this

Fourteenth Day of December 1976

[SEAL]

*Attest:*

RUTH C. MASON
*Attesting Officer*

C. MARSHALL DANN
*Commissioner of Patents and Trademarks*